US006536877B2

(12) United States Patent
Miyamoto et al.

(10) Patent No.: US 6,536,877 B2
(45) Date of Patent: Mar. 25, 2003

(54) PRINTER, PRINTER HEAD, AND METHOD FOR FABRICATING PRINTER HEAD FORMED WITH A MULTILAYER WIRING PATTERN

(75) Inventors: Takaaki Miyamoto, Kanagawa (JP); Toru Tanikawa, Kanagawa (JP); Hideki Mori, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/918,839

(22) Filed: Jul. 31, 2001

(65) Prior Publication Data

US 2002/0057313 A1 May 16, 2002

(30) Foreign Application Priority Data

Aug. 7, 2000 (JP) ..... 2000-243997

(51) Int. Cl.[7] ..... B41J 2/05
(52) U.S. Cl. ..... 347/58; 347/63
(58) Field of Search ..... 347/63, 57–59, 347/61, 64, 56, 65

(56) References Cited

U.S. PATENT DOCUMENTS 4,528,574 A 7/1985 Boyden ..... 347/62
4,695,853 A * 9/1987 Hackleman et al. ..... 347/63
4,866,460 A * 9/1989 Shiozaki ..... 347/58
6,079,811 A 6/2000 Cornell et al. ..... 347/48

FOREIGN PATENT DOCUMENTS

| | | | |
|---|---|---|---|
| EP | 0593133 | 4/1994 | ..... B41J/2/16 |
| EP | 0641658 | 3/1995 | ..... B41J/2/16 |
| EP | 0778139 | 6/1997 | ..... B41J/2/16 |
| JP | 0 8267761 | 10/1997 | ..... B41J/2/16 |

* cited by examiner

*Primary Examiner*—John Barlow
*Assistant Examiner*—Juanita Stephens
(74) *Attorney, Agent, or Firm*—Sonnenschein, Nath & Rosenthal

(57) ABSTRACT

A printer and a printer head employing a thermal inkjet method are disclosed. A heater element is arranged so as to overlie a wiring pattern layer carried by a semiconductor substrate, or a wiring pattern portion for power supplying or a wiring pattern portion for grounding, the wiring pattern portions being carried by a semiconductor substrate. This arrangement allows heat generated by the heater element to be efficiently transferred to a liquid ink chamber.

7 Claims, 6 Drawing Sheets

PRINTER, PRINTER HEAD, AND METHOD FOR FABRICATING PRINTER HEAD FORMED WITH A MULTILAYER WIRING PATTERN

RELATED APPLICATION DATA

The present application claims priority to Japanese Application No. P2000-243997 filed Aug. 7, 2000, which application is incorporated herein by reference to the extent permitted by law.

BACKGROUND OF THE INVENTION

1. Field of the Invention

This invention relates to printers and printer heads. More specifically, the present invention relates to a printer, a printer head, and a method for fabricating a printer head of a thermal method ink-jet printer. In the present invention, a heater element is arranged so as to overlie a wiring pattern layer carried by a semiconductor substrate, or a wiring pattern portion for power supplying or a wiring pattern portion for grounding, the wiring pattern portions being carried by a semiconductor substrate. This allows heat of the heater element to be efficiently transferred to a liquid ink chamber, even when a driving circuit is formed with multilayer wiring.

2. Description of the Related Art

In recent years, there are growing needs for colorization of hard copies in the field of, for example, image processing. In response to the needs, conventionally, methods of colorizing hard copies are proposed, such as a dye sublimation method, thermal wax transfer method, inkjet method, electrophotography method, and thermally processed silver process.

In the inkjet method, dots are formed in such a manner that droplets of a recording liquid (ink) are ejected from nozzles provided in a recording head and are attached to a recording medium, allowing output of high-quality images with a simple configuration. The inkjet method is categorized, by the difference of technologies of ejecting ink, into an electrostatic attraction method, continuous oscillation generating method (piezoelectric method), thermal method, and the like.

In the thermal method, ink is locally heated to generate bubbles causing ink to be pushed out from outlets and splashed onto a printing medium, which allows for printing of colored images with a simple configuration.

A printer employing the thermal method is provided with the so-called a printer head that includes, for example, a heater element for heating ink, a driving circuit of a logic integrated circuit for actuating the heater element.

Referring now to FIG. 6, such a conventional printer head is illustrated in a partial sectional view. In a printer head 1, element isolation regions (LOCOS: Local oxidation of silicon) 3 for isolating a transistor are formed at a p-type silicon substrate 2. In a transistor forming region left between the element isolation regions 3 are provided a gate oxide film and the like, so that a MOS (Metal Oxide Semiconductor) switching transistor 4 is formed.

Further, over predetermined spots of the element isolation regions 3 is deposited $HfB_2$, TaAl, or the like by sputtering, or heater element material such as polysilicon by CVD. This forms a resistance film locally, thereby providing a heater element 5 for heating ink.

In the printer head 1, the switching transistor 4 and the heater element 5 are provided with a wiring pattern 8 made of Al or the like, so that the heater element 5 is connected with the switching transistor 4 for actuating the heater element 5.

Subsequently, insulation material such as $SiO_2$ or SiN is deposited to form an insulating layer 9, and a Ta film is then deposited locally above the heater element 5 to provide an anti-cavitation layer 7. Next, a dry film 11, made of a resin or the like, and an orifice plate 12 are sequentially deposited. Further, a liquid ink chamber 14 having an orifice 13 that is a minute outlet in the orifice plate 12, a flow channel for introducing ink into the liquid ink chamber 14, and the like are formed above the heater element 5.

In the printer head 1, ink is introduced into the liquid ink chamber 14 and heat is generated at the heater element 5 by switching operation of the switching transistor 4, thereby heating the ink locally. This heating generates nucleus bubbles over a surface of the heater element 5, and the nucleus bubbles combine and grow into a film bubble. In the printer head 1, the increase in the bubble pressure causes ink to be pushed out of the orifice 13 and to be splashed onto a printing media. Thus, in a printer with the printer head 1, creation of a desired image is achieved by selectively heating the heater element 5 so that ink is intermittently attached onto a printing media.

In the printer head 1, the switching transistor 4 for energizing the heater element is controlled by a logic integrated circuit including a MOS transistor or bipolar transistor. Such a logic integrated circuit is fabricated concurrently with the switching transistor 4 on the semiconductor substrate 2, whereby the heater elements (only one heater element 5 is shown) can be arranged at a high density. This arrangement, therefore, is adapted to secure energizing the heater element by a corresponding switching transistor.

In order to gain a high-quality image, it is necessary to arrange the heater elements at a high density. That is, to provide, for example, an equivalent quality to 600 DPI, the heater elements needs to be arranged at intervals of 42.333 $\mu$m. However, it is extremely difficult to provide a discrete driving element for each of the heater elements arranged in such a high-density. In the printer head 1, therefore, the switching transistor and the like are fabricated above the semiconductor substrate and are connected to the corresponding heater element 5 by an integrated circuit technology. In addition, the driving circuit formed above the same semiconductor substrate performs driving of each switching transistor. This arrangement can simplify and secure energizing each heater element 5.

In order to perform printing at a higher printing rate and higher resolution, a driving circuit for driving a switching transistor also needs to be improved in the printing rate and performance. To this end, forming a driving circuit of a printer head with multi-layer wiring using aluminum, which is conductive material, is envisaged to improve the operating rate.

With such an arrangement, however, the distance from the heater element 5 to the liquid ink chamber 14 is increased, which poses a problem of inefficient heat transfer from the heater element 5 to the liquid ink chamber 14. That is, when the driving circuit is formed with one-layer wiring, the interlayer thickness on the heater element 5 is about 0.2 to 0.6 $\mu$m. In contrast, when the wiring is formed by adding another layer, the interlayer thickness on the heater element 5 is increased by about 1 to 1.6 $\mu$m. Such an increase in the interlayer thickness on the heater element 5 results in inefficient heat transfer from the heater element 5 to the liquid ink chamber, thus requiring greater power supply to actuate the heater element 5. This can also impair the reliability of the heater element 5.

SUMMARY OF THE INVENTION

In view of the foregoing, an object of the present invention is to provide a printer, a printer head, and a method for fabricating a printer head, which allow efficient heat transfer from a heater element to a liquid ink chamber.

Another object of the present invention is to provide a printer, a printer head, which allow efficient heat transfer, even when a driving circuit is formed with multi-layer wiring.

To this end, according to one aspect of the present invention, there are provided a printer, a printer head, or a method for fabricating a printer head wherein heater elements are arranged at a layer overlying an uppermost wiring pattern layer carried by a semiconductor substrate. As a result, the heater elements can be arranged in closer proximity to liquid ink chambers, thus allowing efficient heat transfer from the heater elements to liquid ink chambers.

According to another aspect of the present invention, there are provided a printer, a printer head, or a method for fabricating a printer wherein heater elements are arranged so as to overlie a wiring pattern portion for power supplying or a wiring pattern portion for grounding, the wiring pattern portion being carried by a semiconductor substrate. As a result, the heater elements can be arranged in closer proximity to liquid ink chambers, as compared to a case in which the heater elements are arranged to underlie the wiring pattern portion. Accordingly, heat of the heater elements can be efficiently introduced to the liquid ink chambers, even when, for example, driving circuits are formed with multi-layer wiring.

DESCRIPTION OF THE PREFERRED EMBODIMENT

Embodiments of the present invention will now be described, by way of example, with reference to the accompanying drawings.

(1) Embodiment 1

(1-1) Configuration of First Embodiment

Figure 1:
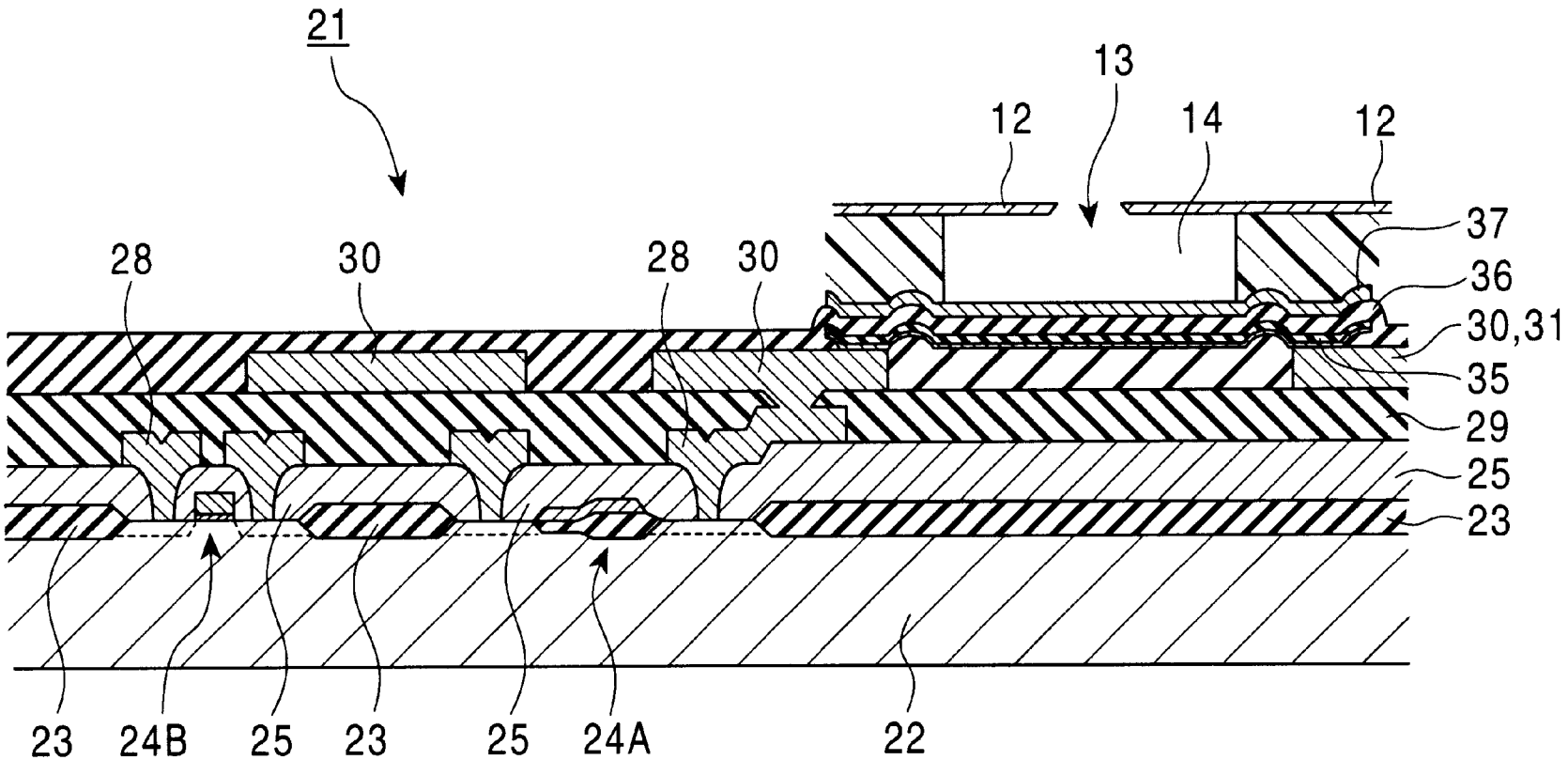
FIG. 1 is a partial sectional view showing a structure of a printer head according to a first embodiment of the present invention.
Figure 6:
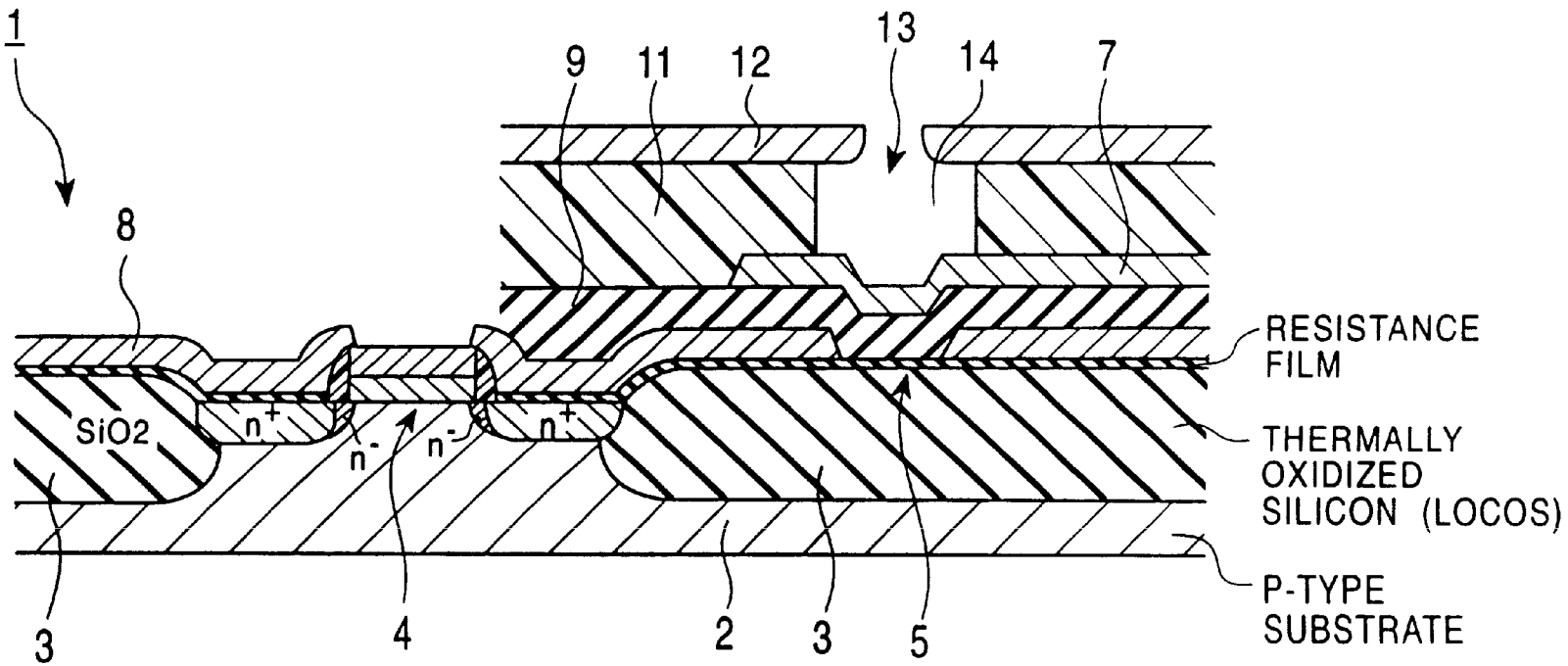
FIG. 6 Prior Art
FIG. 6 is a partial sectional view of a conventional printer head.

FIG. 1 is a partial sectional view of a printer head. A printer head 21 is used in a printer according to a first embodiment of the present invention. In this embodiment, elements that are identical to those of the printer head previously described in conjunction with FIG. 6 are denoted with like reference numerals, and description of such elements shall be omitted for brevity.

Figure 2A:
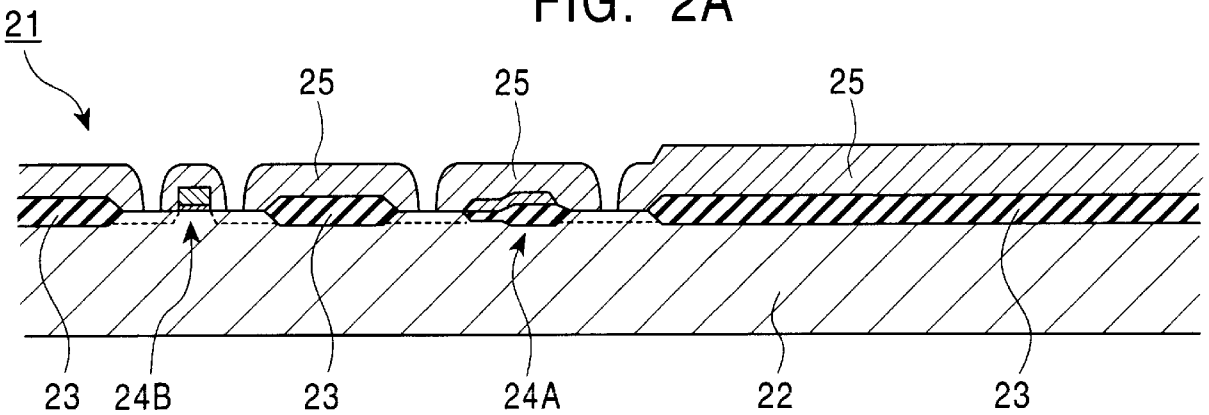
FIGS. 2A and 2B are partial sectional views showing processes.for fabricating the printer head of FIG. 1.

In fabrication of the printer head 21, as shown in FIG. 2A, element isolation regions (LOCOS: local oxidation of silicon) 23 which isolate transistors are formed on a pre-cleaned p-type silicon substrate 22. To fabricate element isolation regions 23, a silicon nitride film is first formed on the p-type silicon substrate 22, and patterned by lithography and reactive ion etching to remove part of the silicon nitride film. Further, the resulting structure is subjected to thermal oxidation treatment with the pattern.

Subsequently, after a cleaning process, gates having a tungsten silicide/polysilicon/thermally oxide film structure are formed in transistor forming regions that have been left between element isolation regions 23. Further, ion implanting for forming source/drain regions and thermal treating are performed to form MOS transistors.

These MOS transistors provide a switching transistor 24A, which is connected via a heater element to a power supply of 30 V, for energizing the heater element, and a transistor 24B of a logic integrated circuit, which is operated by a power supply of 5 V, for driving the switching transistor 24A.

A BPSG (BorophosphoSilicate Glass) film 25 is then deposited by CVD (Chemical Vapor Deposition), and contact holes are formed above a diffusion layer (sources/drains) of the semiconductor substrate by photolithography and reactive ion etching with a CFx gas.

Figure 2B:
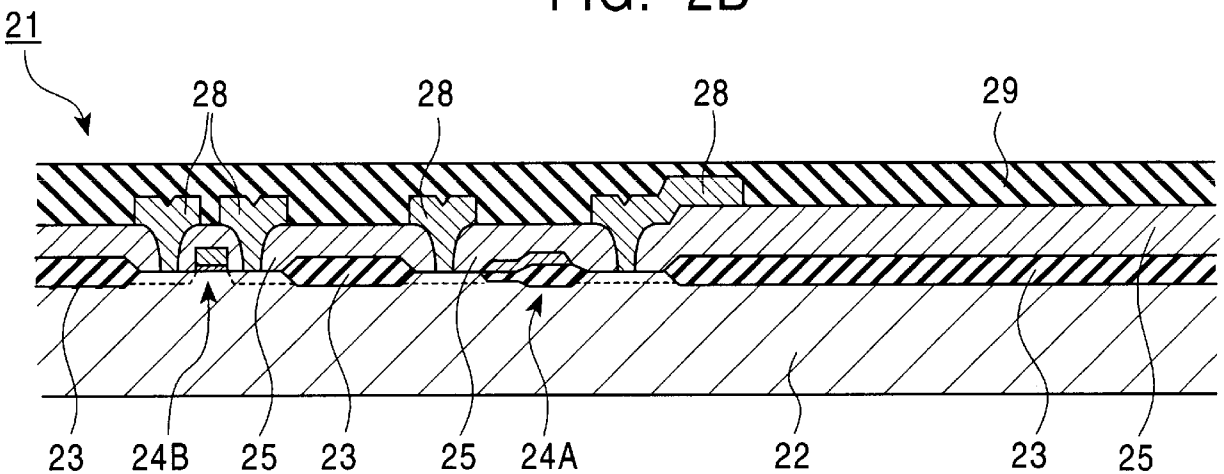

Subsequently, as shown in FIG. 2B, after a cleaning process with dilute hydrofluoric acid, a titanium film having a thickness of 20 nm and a titanium nitride film having a thickness of 60 nm are sequentially deposited by sputtering. Further, aluminum containing copper of 0.6 atomic percent is deposited to have a film thickness of 600 nm. The resulting structure is then subjected to photolithography and dry etching to form a first wiring pattern layer 28. In the printer head 21, the first wiring pattern layer 28 and the MOS transistor 24B that constitutes a driving circuit are interconnected, thereby forming the logic integrated circuit.

Figure 3A:
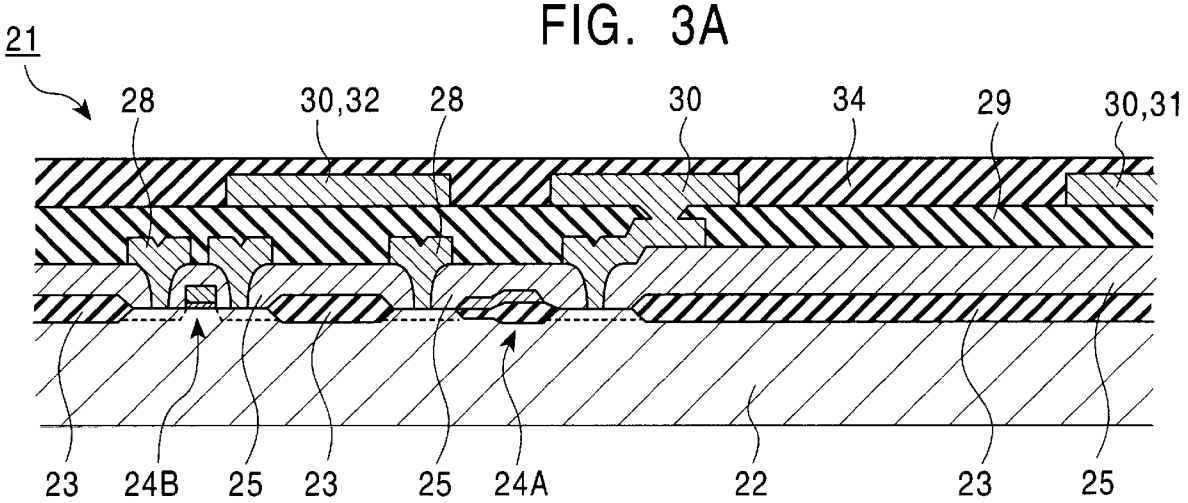
FIGS. 3A and 3B are partial sectional views showing processes for fabricating the printer head of FIG. 1.

Next, on the first wiring pattern layer 28, which is made of aluminum, is deposited a silicon oxidation film (the so-called "TEOS") 29, which is subsequently planarized by a CMP (Chemical Mechanical Polishing) or resist etch-back process Thereafter, as shown in FIG. 3A, a via hole connecting to the first layer aluminum wiring is formed by photolithography and dry etching. An aluminum wiring layer is then formed by sputtering in the same manner as the first wiring layer, and is subjected to photolithography and dry etching to form a second aluminum wiring pattern layer 30. The second wiring pattern layer 30 provides a wiring pattern portion 31 for power supplying and a wiring pattern portion 32 for grounding. Subsequently, a silicon nitride film 34 is deposited by CVD and planarized by a resist etch-back process or the like.

Figure 3B:
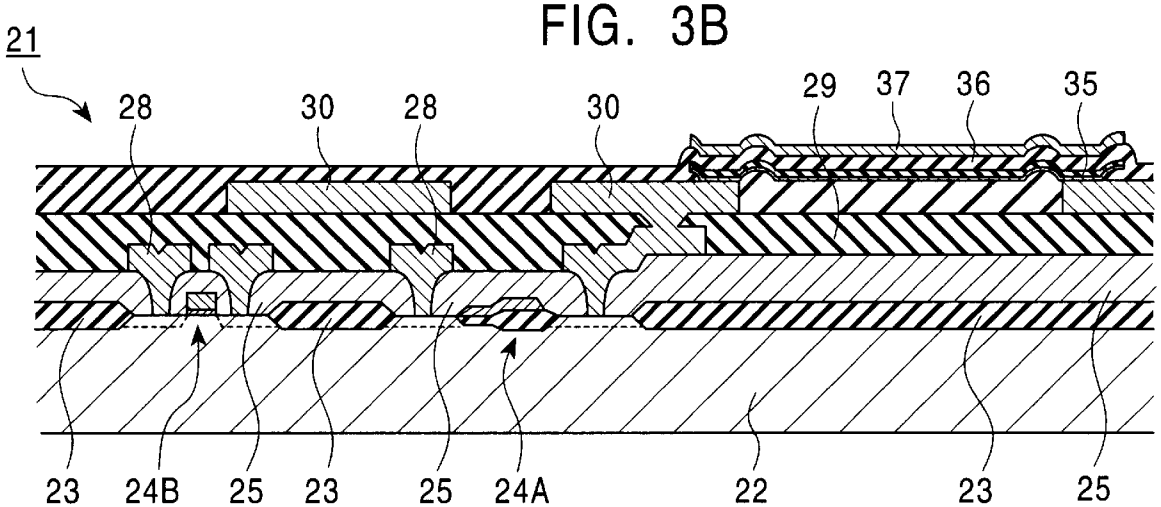

Next, as shown in FIG. 3B, a via hole connecting to the second aluminum wiring pattern layer is formed by photolithography and dry etching. Further, a titanium film having a thickness of 10 nm, and a titanium nitride or tantalum film having a thickness of 100 nm are sequentially deposited from the lower layer by sputtering. The resulting structure is then subjected to photolithography and dry etching to fabricate a heater element 35.

Next, a silicon nitride film 36 that serves as an ink protection layer is formed with a thickness of about 300 nm, and a tantalum film 37 as an anti-cavitation film is formed with a thickness of 200 to 300 nm by sputtering. Finally, a liquid ink chamber 14, a flow channel, and the like are formed to provide the completed printer head 21 as shown in FIG. 1.

(1-2) Operation of First Embodiment

In the above configuration of the printer head 21, as shown in FIG. 2A, the switching transistor 24A and the transistor 24B of the driving circuit are firstly fabricated on the p-type silicon substrate 22. Next, as shown in FIG. 2B, the first wiring pattern layer 28 is formed to connect the transistor 24B of the driving circuit, thereby constituting the driving circuit. Subsequently, the insulating layer 29 is formed, and then, as shown in FIG. 3A, the second wiring pattern layer 30 is formed, thereby connecting the driving circuit to the wiring pattern portion for power supplying and the switching transistor 24A. Further, a wiring pattern portion for connecting the switching transistor 24A to the heater element, and the wiring pattern portion 31 for connecting the heater element to a power supply are formed.

Next, the heater element 35 is fabricated so as to overlie those wiring patterns, and then the protection layer 36 and the anti-cavitation layer 37 are sequentially deposited to form the liquid ink chamber and the like. This arrangement allows the heater element 35 to be fabricated so as to overlie the wiring pattern portion for power supplying, so that the heater element 35 is in contact with the liquid ink chamber 14 via the protection layer 36 and the anti-cavitation layer 37. Thus, in the printer head 21, heat generated by the heater element 35 can be rapidly transmitted to the liquid ink chamber 14, thus allowing heat of the heater element 35 to be efficiently transferred to the liquid ink chamber 14. As a result, the heater element 35 can be energized with small electric power to eject an ink droplet from the printer head 21; therefore, the reliability of the heater element 35 is enhanced to allow for high rate printing.

(1-3) Advantage of First Embodiment

According to the above configuration, a heater element is arranged so as to overlie a wiring pattern portion for power supplying, the wiring pattern portion for power supplying being arranged at an uppermost wiring pattern. This arrangement, therefore, allows efficient heat transfer from the heater element to a liquid ink chamber, even when a driving circuit is formed with multi-layer wiring.

(2) Embodiment 2

Figure 4:
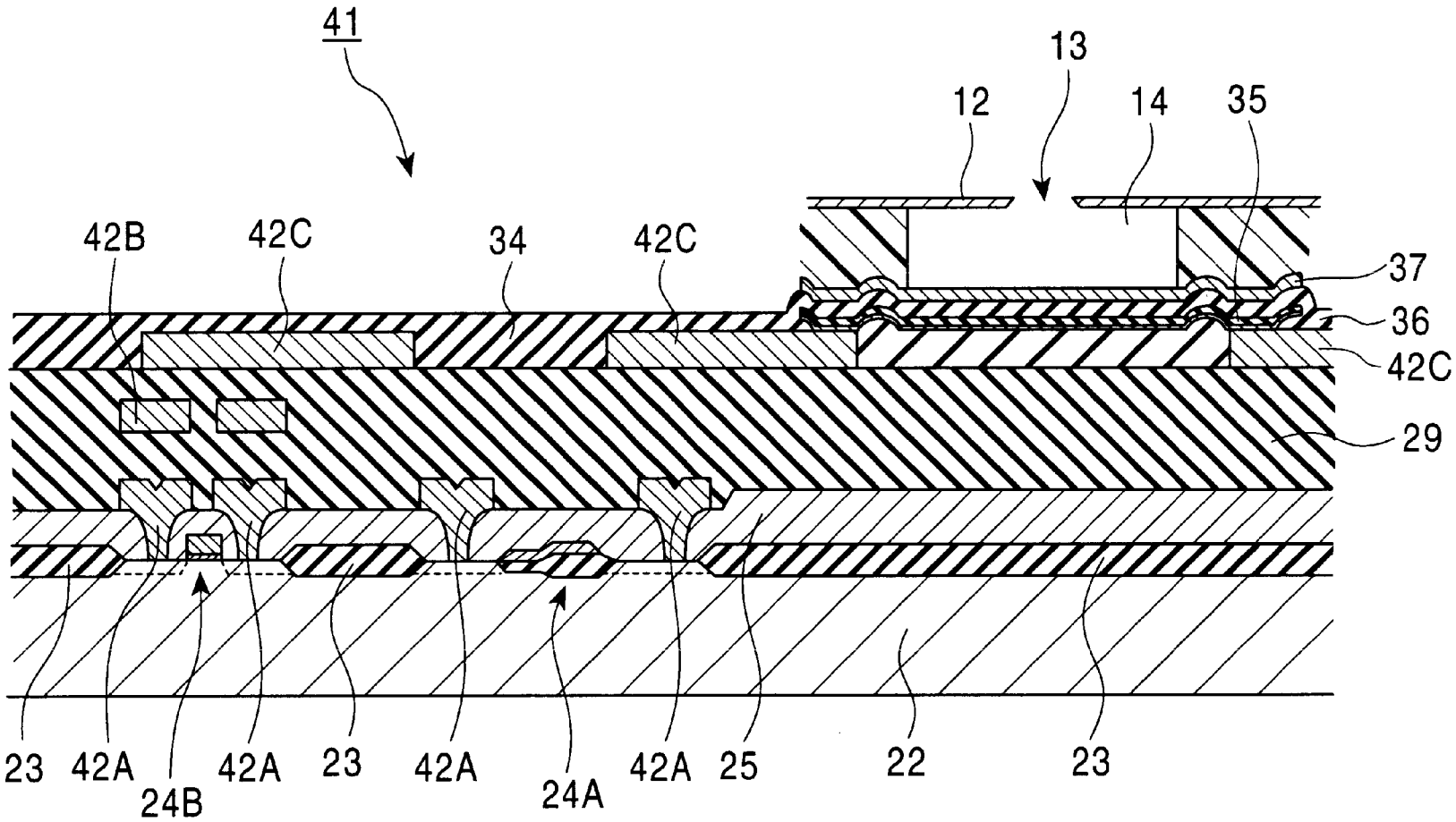
FIG. 4 is a partial sectional view of a printer head according to a second embodiment of the present invention.

Referring now to FIG. 4, a printer head to be incorporated in a printer according to a second embodiment of the present invention is shown in a partial sectional view. In the configuration shown in FIG. 4, elements that are identical to those of the printer head previously described in conjunction with FIG. 1 are denoted with like reference numerals, and description of such elements shall be omitted for brevity.

In a printer head 41, a first wiring pattern layer 42A and a second wiring pattern layer 42B form a logic integrated circuit. Further, the first wiring pattern layer 42A interconnects a driving circuit and the switching transistor 24A. A third wiring pattern layer 42C connects the driving circuit to a ground and a power supply, and also provides a wiring pattern for the heater element 35. In the printer head 41, therefore, the heater element 35 is arranged so as to overlie the wiring pattern portion for power supplying, the wiring pattern portion for power supplying being arranged at the uppermost wiring pattern layer of the three-layer wiring structure. Thereafter, the protection layer 36, the anti-cavitation layer 37, and the liquid ink chamber 14, and the like are formed.

According to the configuration shown in FIG. 4, the heater element is arranged so as to overlie the wiring pattern portion for power supplying, the wiring pattern portion for power supplying being arranged at the uppermost wiring layer. This arrangement can provide the same advantage as in the first embodiment, even for wiring patterns of a three-layer structure.

(3) Embodiment 3

Figure 5:
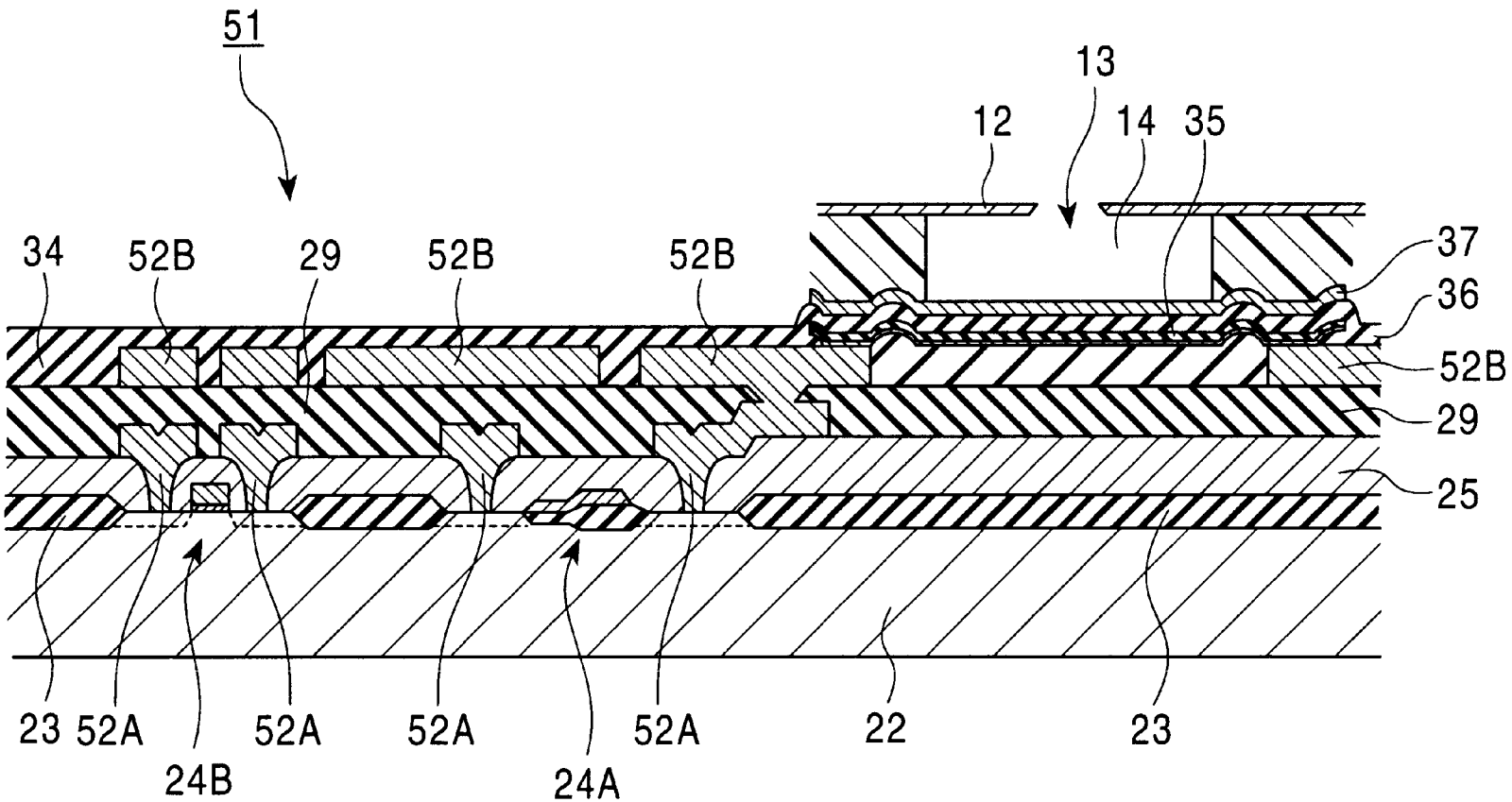
FIG. 5 is a partial sectional view of a printer head according to a third embodiment of the present invention.

Referring now to FIG. 5, a printer head to be incorporated in a printer according to a third embodiment of the present invention is shown in a partial sectional view. In the configuration shown in FIG. 5, elements that are identical to those of the printer head previously described in conjunction with FIG. 1 are denoted with like reference numerals, and description of such elements shall be omitted for brevity.

In a printer head 51, a first wiring pattern layer 52A and a second wiring pattern layer 52B form a logic integrated circuit. Further, the first wiring pattern layer 52A interconnects a driving circuit and the switching transistor 24A. The second wiring pattern layer 52B connects the driving circuit to a ground and a power supply, and also provides a wiring pattern for the heater element 35. Thus, the printer head 51 is configured with a two-layer wiring structure that includes the driving circuit, wherein the heater element 35 is arranged so as to overlie the wiring pattern portion for power supplying, the wiring pattern portion for power supplying being arranged at the uppermost wiring pattern layer of the structure.

According to the configuration shown in FIG. 5, the heater element is arranged so as to overlie the wiring pattern portion for power supplying, the wiring pattern portion for power supplying being arranged at the uppermost wiring layer. This arrangement can provide the same advantage as in the first embodiment, even for wiring patterns of a two-layer structure.

(4) Other Embodiments

In the embodiments described above, the heater element has been described as being arranged closer to a power supply and being actuated by a switching transistor; however, the present invention is not limited thereto. For example, the present invention can be widely applied, as opposed to the aforementioned embodiments, to a case in which a heater element is energized with negative power supply, wherein the heater element is arranged closer to a ground and is actuated by a switching transistor. In such a case, the heater element may be arranged so as to overlie a wiring pattern portion for grounding, the wiring pattern portion for grounding being arranged at an uppermost wiring layer carried by a semiconductor substrate.

In the embodiments described above, the description has been given for the case in which the driving circuit and the like are formed with multi-layer wiring; however, the present invention is not limited thereto. For example, even when the driving circuit and the like are formed with one-layer wiring, arranging a heater element so that the heater element overlies a wiring pattern portion for power supplying or a wiring pattern portion for grounding allows for closer arrangement of the heater element to a liquid ink chamber by a thickness of the wiring pattern. This allows efficient heat transfer from the heater element to the liquid ink chamber, as compared to a conventional one.

Further, in the embodiments described above, the description has been given for the case in which the heater element is formed by deposition of a titanium nitride film and a titanium film, the wiring pattern portions by deposition of aluminum and the like, and the anti-cavitation layer by tantalum. However, the present invention is not limited thereto. For example, the present invention can be widely applied to cases in which a heater element, wiring patterns, and an anti-cavitation layer are formed of various materials, including a case in which the heater element is formed of polysilicon.

As described above, according to the present invention, a heater element is arranged so as to overlie a wiring pattern layer carried by a semiconductor substrate, or a wiring pattern portion for power supplying or a wiring pattern portion for grounding, the wiring pattern portions being carried by a semiconductor substrate. This allows heat of a heater element to be efficiently transferred to a liquid ink chamber, even when a driving circuit is formed with multilayer wiring.

While the present invention has been particularly shown and described with reference to specific embodiments thereof, it should be understood that other embodiments of the present invention beyond embodiments specifically described herein may be made or practiced without departing from the scope of the invention. Accordingly, such undisclosed and apparent embodiments, changes, variations, and modifications are considered to be within the spirit and scope of the present invention.

What is claimed is:

1. A printer head that performs printing by heating ink in liquid ink chambers so that ink droplets are ejected from selected orifices, the printer head comprising:

(a) a semiconductor substrate, the semiconductor substrate carrying heater elements to heat the ink;

(b) switching transistors to actuate the heater elements;

(c) driving circuits to drive the switching transistors;

(d) at least one wiring pattern layer comprising a plurality of wiring pattern layers; and (e) wherein the heater elements overlie the at least one wiring pattern layer.

2. A printer head that performs printing by heating ink in liquid ink chambers so that ink droplets are ejected from selected ones of orifices, the printer head comprising:

(a) a semiconductor substrate, the semiconductor substrate carrying heater elements to heat the ink;

(b) switching transistors to actuate the heater elements;

(c) driving circuits for driving the switching transistors;

(d) at least one wiring pattern layer, the at least one wiring pattern layer including a wiring pattern portion for power supplying and a wiring pattern portion for grounding; and (e) wherein the heater elements overlie the wiring pattern portion for power supplying or the wiring pattern portion for grounding.

3. The printer head of claim 2, wherein the at least one wiring pattern layer comprises a plurality of wiring pattern layers.

4. A printer head that ejects ink droplets from selected ones of orifices by heating ink in liquid ink chambers, the printer head comprising:

(a) a semniconductor substrate, the semiconductor substrate carrying heater elements to heat the ink;

(b) switching transistors to actuate the heater elements;

(c) driving circuits to drive the switching transistors;

(d) at least one wiring pattern layer comprising a plurality of wiring pattern layers; and (e) wherein the heater elements overlie the at least one wiring pattern layer.

5. A printer head that ejects ink droplets from selected ones of orifices by heating ink in liquid ink chambers, the printer head comprising:

(a) a semiconductor substrate, the semiconductor substrate carrying heater elements to heat the ink;

(b) switching transistors to actuate the heater elements;

(c) driving circuits to drive the switching transistors;

(d) at least one wiring pattern layer, the at least one wiring pattern layer including a wiring pattern portion for power supplying and a wiring pattern portion for grounding; and (e) wherein the heater elements overlie the wiring pattern portion for power supplying or the wiring pattern portion for grounding.

6. A method for fabricating a printer head that has a semiconductor substrate, the semiconductor substrate carrying heater elements, switching transistors for actuating the heater elements, driving circuits for driving the switching transistors, and at least one wiring pattern layer, the method comprising:

the step of providing the heater elements so that the heater elements overlie the at least one wiring pattern layer, the at least one wiring pattern layer comprising a plurality of wiring pattern layers.

7. A method for fabricating a printer head that has a semiconductor substrate, the semiconductor substrate carrying heater elements, switching transistors for actuating the heater elements, driving circuits for driving the switching transistors, and at least one wiring pattern layer including a wiring pattern portion for power supplying and a wiring pattern portion for grounding, the method comprising:

the step of providing the heater elements so that the heater elements overlie the at least one wiring pattern layer.

* * * * *